United States Patent [19]

Lenhardt

[11] Patent Number: 4,702,017

[45] Date of Patent: Oct. 27, 1987

[54] DRYER FOR DRYING WASHED GLASS PLATES

[75] Inventor: Karl Lenhardt, Heuhausen-Hamberg, Fed. Rep. of Germany

[73] Assignee: Lenhardt Maschinenbau GmbH, Neuhausen-Hamberg, Fed. Rep. of Germany

[21] Appl. No.: 900,673

[22] Filed: Aug. 27, 1986

[30] Foreign Application Priority Data

Aug. 28, 1985 [DE] Fed. Rep. of Germany ... 8524541[U]

[51] Int. Cl.[4] ..... F26B 15/00

[52] U.S. Cl. ..... 34/107; 34/150; 34/228; 15/306 B

[58] Field of Search ..... 34/69, 107, 150, 228; 15/306 A, 306 B

[56] References Cited

U.S. PATENT DOCUMENTS

| | | | |
|---|---|---|---|
| 30,436 | 10/1860 | Tourne | 34/235 |
| 1,692,812 | 11/1928 | Blakeslee | 34/228 |
| 2,706,344 | 4/1955 | Vaughn | 34/228 |
| 3,062,520 | 11/1962 | Frey et al. | 34/150 |

*Primary Examiner*—Albert J. Makay
*Assistant Examiner*—David W. Westphal
*Attorney, Agent, or Firm*—Balogh, Osann, Kramer, Dvorak, Genova & Traub

[57] ABSTRACT

Dryer for drying washed glass plates as they travel in a housing having an entrance slot and an exit slot and contains a conveyor having bottom members and backing elements defining a plane of travel for the glass plates. Elongate front and rear blast nozzles are provided and which are respectively disposed on both sides of the plane of travel and are upwardly inclined opposite to the direction of travel and have air exit slots which face the plane of travel and extend upwardly from a level which is close to the level of the bottom edge supporting conveyor. Respective shields are provided between the blast nozzles and the adjacent walls of the housing. The housing has an exhaust air outlet. In one embodiment, the top end of each blast nozzle is spaced from the entrance end wall of the dryer and the exhaust air opening is formed in the top wall of the housing between the upper ends of the blast nozzles and the entrance end wall of the dryer. In another embodiment, each shield extends between one of the blast nozzles and the adjacent side wall of the housing and is contiguous to said adjacent side wall up to a predetermined level along a line which is approximately parallel to the blast nozzle and above said level is contiguous to said side wall along a steeper line, and the exhaust air outlet is formed in the top wall of the housing at the top end of a duct which is defined by the shields and the entrance end wall of the dryer.

10 Claims, 5 Drawing Figures

DRYER FOR DRYING WASHED GLASS PLATES

BACKGROUND OF THE INVENTION

1. Field of the Invention

This invention relates to a dryer for drying washed glass plates as they travel in a housing, which has a dryer entrance slot and a dryer exit slot and contains a horizontal conveyor for the glass plates, which conveyor comprises and serves to support a bottom edge supporting conveyor and backing elements, which define a plane of travel for the glass plates and serve to support glass plates at one of their broadsides when the glass plates stand on the bottom edge supporting conveyor, which dryer also comprises elongate front and rear blast nozzles, which are respectively disposed in front of and behind the plane of travel for the glass plates and are upwardly inclined opposite to the direction of travel and have air exit slots or perforation lines, which face the plane of travel for the glass plates and extend from a level which is close to the level of the bottom edge supporting conveyor in a direction which is upwardly inclined opposite to the direction of travel, wherein respective shields are provided between the front blast nozzle and the adjacent front wall of the housing and between the rear blast nozzle and the adjacent rear wall of the housing, and wherein the housing is provided with an exhaust air outlet.

Such dryer is required in an insulating glass assembling line, in which the dryer succeeds a washing machine, which serves to wash glass plates as they travel through the machine. The glass plates then enter the dryer and are dried as they travel through the dryer. The dryer and the washing machine are often combined in a unit.

2. Description of the Prior Art

The known dryers comprise a horizontal conveyor, which serves to move the glass plates through the dryer as the glass plates stand on the conveyor and are supported at one of their two broadsides by means of backing elements which generally consist of rollers which are freely rotatable about axles which are transverse to the direction of travel of the horizontal conveyor. Those surfaces of said rollers which contact the glass plates define a common plane, which will be described hereinafter as a plane of travel for the glass plates. This is the plane which is continuous to that broadside at which the glass plates contact the rollers. In the dryer, the plane of travel for the glass plates is a fixed plane that is defined by the backing elements are accommodated in a housing, which has two dryer end walls which cross the direction of travel of the horizontal conveyor and which are respectively formed with an entrance slot and an exit slot for receiving and delivering the glass plates. Said slots are aligned with the plane of travel for the glass plates.

The housing also contains two elongate blast nozzles, which are respectively disposed in front of and behind the plane of travel of the glass plates. The air exit slot or perforation line of each blast nozzle extends substantially parallel to the plane of travel of the glass plates and rises from a level which is close to the level of the bottom edge supporting conveyor in which a direction which is upwardly inclined opposite to the direction of conveyance. The air exit slots of the blast nozzles are so oriented that they direct an air stream opposite to the direction of travel toward the plane of travel for the glass plates at an oblique angle to said plane so that each broadside of each glass plate which is conveyed by the horizontal conveyor will initially be contacted by the air from the adjacent blast nozzle at the leading upper corner of the glass plate and will then be swept by a front of blast air in a progressively increasing area, which depends on the inclination of the exit slot or perforation of the blast nozzle, until the plate is finally contacted by the air blast at the trailing lower corner of the glass plate so that said corner is the last portion of the glass plate at which said plate is dried. As a result, any water droplets disposed on the glass plate are urged by the air streams in a downwardly inclined direction opposite to the direction of travel of the glass plate. To ensure that the streams of humid air cannot contact that portion of the glass plate which has already moved past the two blast nozzles, a shield is provided between each blast nozzle and the adjacent front or rear wall of the housing. That shield may consist of a rubber lip, which is secured on one side to the blast nozzle to extend along the same whereas the other longitudinal edge of the rubber lip contacts the adjacent forward or rear wall of the housing.

The air which hast been discharged by the blast nozzle must be able to escape from the housing of the apparatus. That air could not escape at the bottom of the housing because the bottom edge supporting conveyor and a water-collecting tub are provided at said bottom. The exhaust air must not and cannot leave the housing in the direction of travel because in that case the exhaust air would remoisten the dried glass plates. It is also impossible to discharge the exhaust air from the housing opposite to the direction of travel because the washing machine is provided at the entrance end of the housing. It is not desirable to discharge the exhaust air at the front side of the housing because in that case the exhaust air would be blown against the operators and because it is desired to cover said front side with glass panes on a large area so that the drying operation can be watched and checked at any time. In the known dryers the exhaust air cannot be conducted through the top wall of the housing because that top wall cannot be provided with an outlet for exhaust air. This is due to the fact that the blast nozzles of the known apparatus terminate only a small distance from the entrance wall of the dryer so that there would be no space for an exhaust air outlet in the region between the top end of the two blast nozzles and the entrance end wall, particularly because the pipes for supplying air to the two blast nozzles occupy a certain space and open into the blast nozzles from above in that region. That portion of the housing top wall which in the direction of travel succeeds the upper end of the blast nozzles cannot be provided with an exhaust air outlet because said portion of the top wall overlies that dry compartment of the housing which is separated by the shields from the wet compartment near the entrance. The air stream does not and should not enter that dry compartment. For this reason the rear wall of the housing of the known dryer has been formed with a bulge, which constitutes a vertical duct for the exhaust air so that the air discharged by the rear blast nozzle can easily enter said exhaust air duct. But the known dryers have the disadvantage that the air discharged by the front blast nozzle can reach the exhaust air duct only with difficulty because that air discharged from the front blast nozzle initially flows in a downwardly inclined direction and must then be deflected to flow across the top edge of the glass plate into the rear region of the housing. The difficulties which arise from that necessity increase with the height of the glass plates which are to be dried because an increase of the height of the glass plate will result in a decrease of the flow area which is defined by the entrance end wall of the housing, the top wall of the housing, the blast nozzles and the top edge of the glass plate and through which the air can flow into the space behind the glass plate. As a result, high glass plates cannot be dried as effectively as small glass plates so that the drying of high glass plates takes much more time.

SUMMARY OF THE INVENTION

It is an object of the invention to provide an improved apparatus which is of the kind described first hereinbefore and can dry particularly also high glass plates more quickly and more thoroughly.

In accordance with a first aspect of the invention that object is accomplished in that the top end of each blast nozzle is spaced from the entrance end wall of the dryer and the exhaust air opening is formed in the top wall of the housing between the upper ends of the blast nozzles and the entrance end wall of the dryer.

Such an arrangement differs from the prior art in that the top end of each blast nozzle is not close to the entrance end wall of the dryer but is spaced from said entrance end wall by a distance which is much larger than the smallest distance required for the installation and mounting in the housing. That larger distance preferably amounts to at least 20 cm and particularly to 30 to 50 cm and is utilized in accordance with the invention to permit the provision of the exhaust air outlet in the top wall of the housing between the top ends of the nozzles and the entrance end wall. That exhaust air outlet preferably extends throughout the area between the entrance end wall of the dryer and the top ends of the blast nozzles in the longitudinal and transverse directions.

In the arrangement in accordance with that aspect of the invention, the air that has been discharged by the front blast nozzle can reach the exhaust air outlet in the housing top just as easily as the air which has been discharged by the rear blast nozzle so that the air from the front blast nozzle need no longer flow across the top edge of the glass plates into the rear part of the interior of the housing. In the prior art, the flow of said air into said rear space was almost entirely blocked by large glass plates, It is also important that in the known dryers a high turbulence was produced on the front of high glass plates being dried and that such turbulence is substantially avoided in the dryer in accordance with that first aspect of the invention because the exhaust air can escape freely also from the housing space on the front side of the glass plate.

A dryer designed in accordance with the first aspect of the invention is larger than the known dryer in dependence on the dimensions of the exhaust air outlet provided at the top. But the additional expenditure involved therein is more than offset by the improved drying action, which permits the drying to be effected in a shorter time, so that the length of the drying zone can be reduced.

A dryer designed in accordance with the second aspect of the invention need not be longer than known dryer because it comprises an exhaust air duct which precedes the top ends of the blast nozzles when viewed in the direction of travel. To ensure that the humid air will not flow in contact with that portion of each glass plate which has already been moved past the two blast nozzles, the invention teaches that each of the shields which extends between one of the blast nozzles and the adjacent side wall of the housing is contiguous to said housing wall only up to a predetermined level along a line which is approximately parallel to the blast nozzle, as is also the case in known dryers, whereas a difference from the prior art resides in that the shield is contiguous to the housing side wall above said predetermined level along a steeper line, particularly along a vertical line, so that said shields define a rising duct through which the exhaust air from both sides of the glass plates can flow equally freely to an exhaust air outlet provided in the top wall of the housing and can escape through said outlet. The flow area of the exhaust air outlet is preferably approximately as large as the flow area of the exhaust air duct and in particular the exhaust air outlet preferably extends throughout the width of the housing. The exhaust air outlet may be as long as the exhaust air outlet provided in accordance with the first aspect of the invention and that length should be at least 20 cm and preferably 30 to 50 cm. In a preferred arrangement the air supply pipes entering the blast nozzles at the top thereof extend through the exhaust air outlet into the housing and the exhaust air outlet is correspondingly larger in size and is increased in length approximately by the diameter of the air supply pipes.

A feature which is common to the arrangements in accordance with the first and second aspects of the invention resides in that a sufficiently large exhaust air duct is defined in the upper portion of the housing of the dryer near the entrance end thereof and said duct leads to an exhaust air outlet formed in the top wall of the housing and permits the exhaust air to escape from one side of the glass plates just as easily as from the other side. In both cases the drying action is much better than that which is achieved in known dryers so that the drying times can be greatly reduced, e.g., by a reduction of the length of the drying zone.

DETAILED DESCRIPTION OF THE PREFERRED EMBODIMENTS

Figure 1:
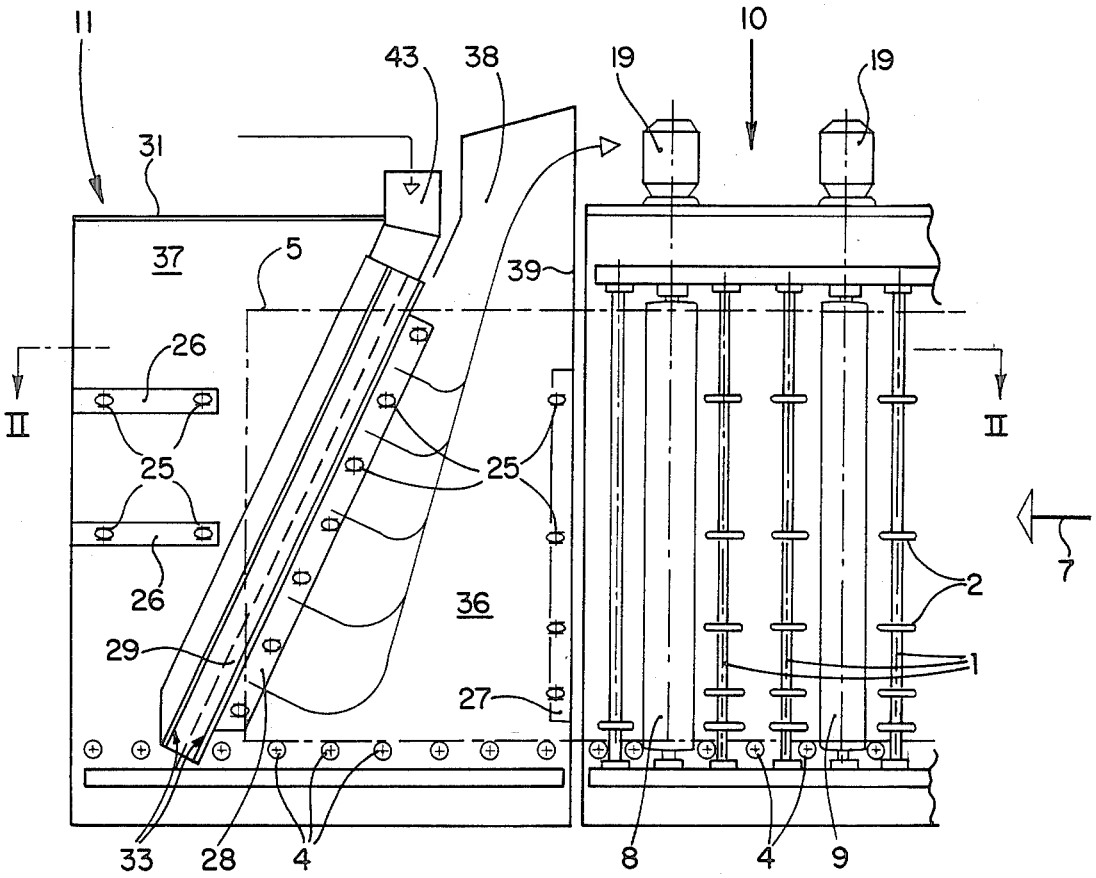
FIG. 1 is a front elevation showing a dryer which succeeds a washing machine and from which the front wall of the housing has been removed so that interior parts are visible.
Figure 2:
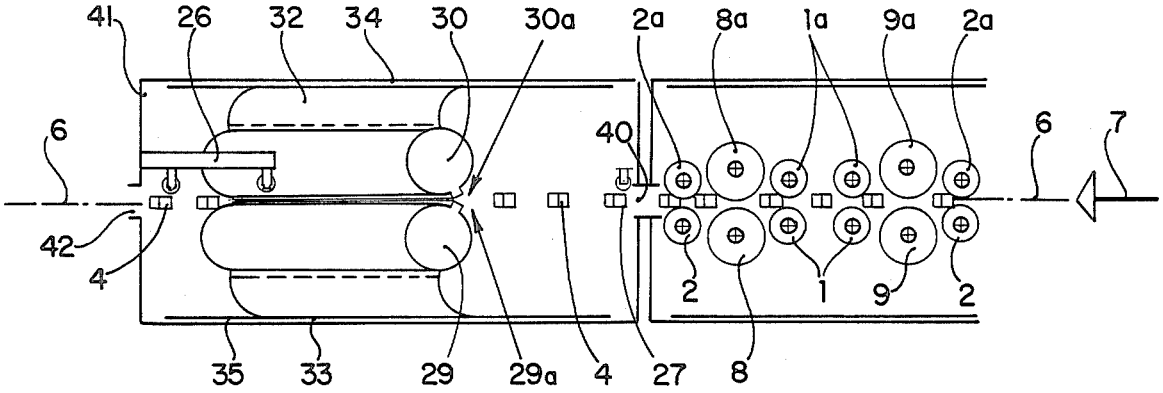
FIG. 2 is a transverse sectional view taken on line II—II in FIG. 2.

FIGS. 1 and 2 show a glass plate washing machine 10 which is succeeded in the direction of travel by a dryer 11. The washing machine contains two rows of parallel shafts 1 and 1*a*, which are approximately vertical and slightly rearwardly inclined. Each of the shafts 1 and 1*a* carries a plurality of spaced apart rollers 2 or 2*a*, which are non-rotatably secured to the shaft 1 or 1*a*. The peripheral surfaces of the rollers 2*a* on the rear shafts 1*a* define on their front side a common tangential plane 6, which is described as a plane of travel for the glass plates. Glass plates 5 which have been moved through the washing machine bear at their rear broadside, which coincides with the plane of travel for the glass plates, against the rear rollers 2*a*. Each glass plate 5 stands at its lower edge on a horizontal row of carrying rollers 4, which have axes of rotation which are at right angles to the plane of travel for the glass plates.

The washing machine is provided with brush rollers 8 and 8*a*, 9 and 9*a*, which serve to clean the glass plates 5 and have axes of rotation which are parallel to the axes of the shafts 1 and 1*a*. Each of the brush rollers 8, 8*a*, 9 and 9*a* is adapted to be individually driven by an associated motor 19, which is disposed above the associated brush roller and secured to the frame. The means for driving the brush rollers are independent of the means for rotating the shafts 1 and 1*a* and the means for driving the carrying rollers 4.

Means are provided for driving the shafts 1 and 1*a* and the carrying roller 4 are included in a horizontal conveyor for conveying the glass plates 5 through the washing machine 10. The horizontal conveyor extends into the dryer 11, in which another horizontal row of carrying rollers 4 are provided, which have axes of rotation that are at right angles to the plane of travel 6 for the glass plates and are disposed on the same level as the corresponding carrying rollers 4 in the washing machine 10 and adapted to be driven in synchronism with the latter rollers 4. In the drying apparatus 11 the glass plates 5 are backed at their rear broadside by an array of backing rollers, which are disposed above the bottom edge supporting conveyor which is constituted by the carrying rollers 4. Said array consists of rollers 25, which are freely rotatable about stationary axes which are parallel to the plane of travel 6 for the glass plates and at right angles to the direction of travel 7. In the embodiment shown in FIGS. 1 to 3, the axles of a first group of the rollers 25 are secured to horizontal struts 26, the axles of a second group of the rollers 25 are secured to a vertical strut 27, and the axles of a third group of the rollers 25 are secured to an inclined strut 28. The inclined strut 28 is secured to the body of the rear one of two elongate blast nozzles 29 and 30, which consist of a front blast nozzle 29 disposed in front of the plane of travel 6 for the glass plates and a rear blast nozzle 30 disposed behind the plane of travel 6 for the glass plates. The two blast nozzles 29 and 30 are parallel to each other and to the plane of travel 6 for the glass plates and extend from a level which is close to the level of the carrying rollers 4 to a level which is slightly above the top of the highest glass plate that is intended to be dried. This means in practice that the top end of the blast nozzles 29 and 30 is slightly above the top end of the brush rollers 8 and 9 in the preceding washing machine 10. The top wall 31 of the housing extends slightly above the top ends of the blast nozzles. The blast nozzles are inclined to extend upwardly and opposite to the direction of travel 7 and their air exit slots 29*a* and 30*a* are so oriented that the air streams discharged by said slots will impinge on the glass plates 5 at an oblique angle in a direction which is opposite to the direction of travel 7 rather than at right angles to the glass plates. Each air exit slot 29*a* or 30*a* may be replaced by a perforation line or a series of longitudinally aligned slots, which are separated by short lands.

A shield 32 or 33 is disposed on that side of each blast nozzle 29 or 30 which faces away from the plane of travel 6 for the glass plates. Each shield 32 or 33 extends throughout the length of the adjacent blast nozzle and as far as to the adjacent housing wall, consisting of the rear wall 34 or the front wall 35. The shields 32 and 33 consist of wide rubber lips, which are convexly curved in the direction of travel 7 and owing to the elasticity of the rubber engage the rear wall 34 or the front wall 35 under a small contact pressure. By the rubber lips and the blast nozzles the interior of the housing of the dryer 10 is divided into a first compartment 36, which receives the air blasts, and a second compartment 37, which is shielded from the compartment 36. Owing to the air blasts which are blown into the first compartment 36, the same is under a superatmospheric pressure, which increases the pressure under which the rubber lips 32 and 33 are urged against the front and rear walls 34 and 35, respectively, of the housing. Owing to the presence of the rubber lips, the moisture-laden air cannot flow from the first compartment 36 into the second compartment 37 so that the moisture-laden air cannot remoisten that portion of each glass plate 5 which has already moved past the blast nozzles 29 and 30 and into the second compartment 37. The air discharged by the blast nozzles flows initially in a downwardly inclined direction so that water droplets on the glass plate 5 will be urged downwardly by the air blasts. The air blasts are then deflected to flow an upward direction and finally escape into the open through an exhaust air outlet 38, which is formed in the top wall 31 of the housing. The exhaust air outlet extends virtually throughout the width of the top wall 31 of the housing and in the direction of travel 7 extends from the entrance end wall 39 of the housing approximately or exactly as far as to a line which is vertically aligned with the top ends of the blast nozzles 29 and 30. The length of said exhaust air outlet is preferably between 30 and 50 cm. Owing to that design, the exhaust air can flow without a substantial turbulence in an upward direction from the front and rear sides of a glass plate 5 even if it is very high.

To permit the glass plates 5 to enter the housing and to exit therefrom, the entrance end wall 39 of the housing is formed with an entrance slot 40 and the exit end wall 41 of the housing is formed with an exit slot 42. The two slots 40 and 42 are aligned with the plane of travel 6 for the glass plates.

Air is supplied to the blast nozzles 29 and 30 through two pipes 43 and 44, which extend into the housing from above through the top wall 31 of the housing in that region which when viewed in the direction of travel 7 succeeds the exhaust air outlet 38. The pipes 43 and 44 open into the top ends of the respective blast nozzles 29 and 30.

Figure 3:
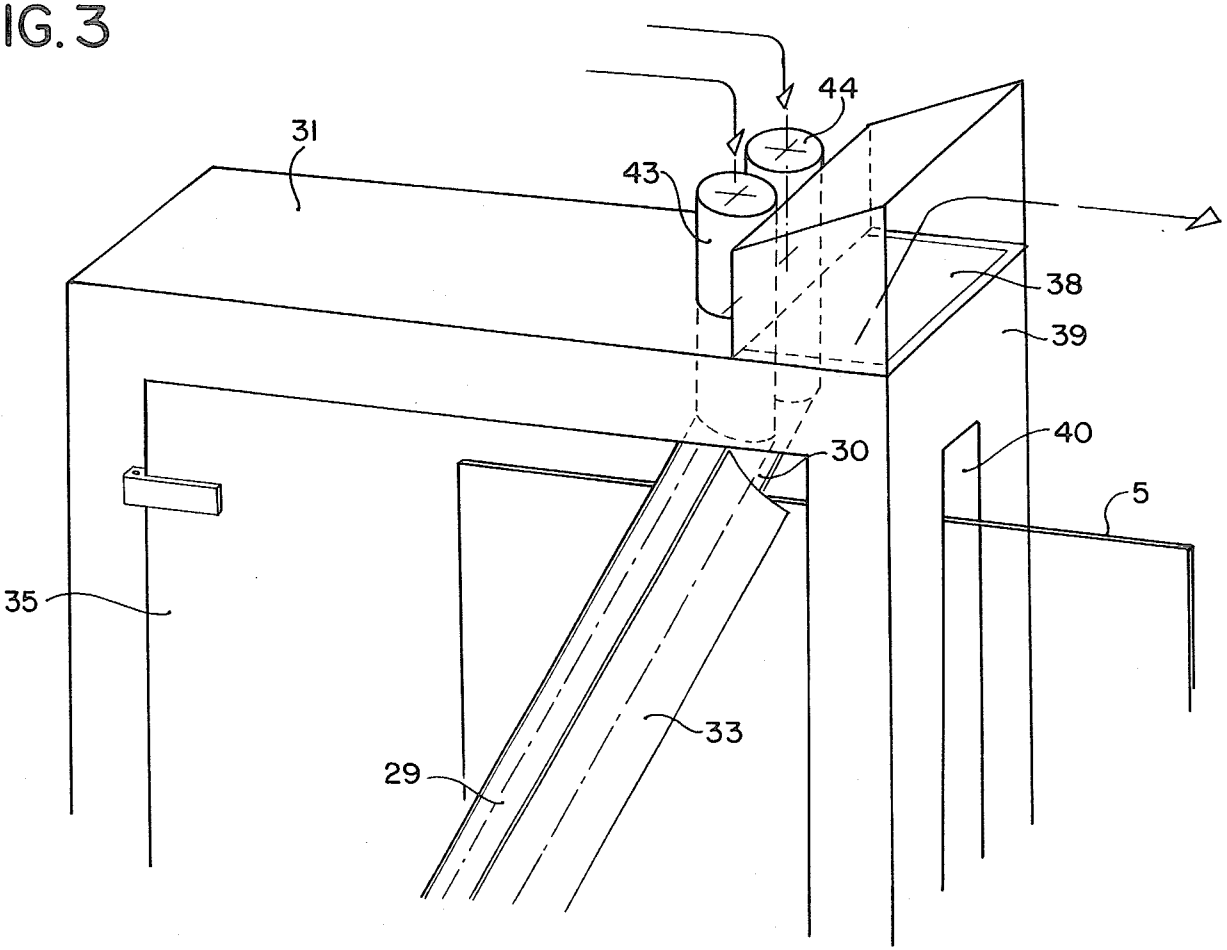
FIG. 3 is a perspective view showing the upper portion of the dryer of FIG. 1.

It is apparent from FIG. 3 that a major portion of the front wall of the housing is constituted by a large glazed door, through which the drying operation can be supervised.

Figure 4:
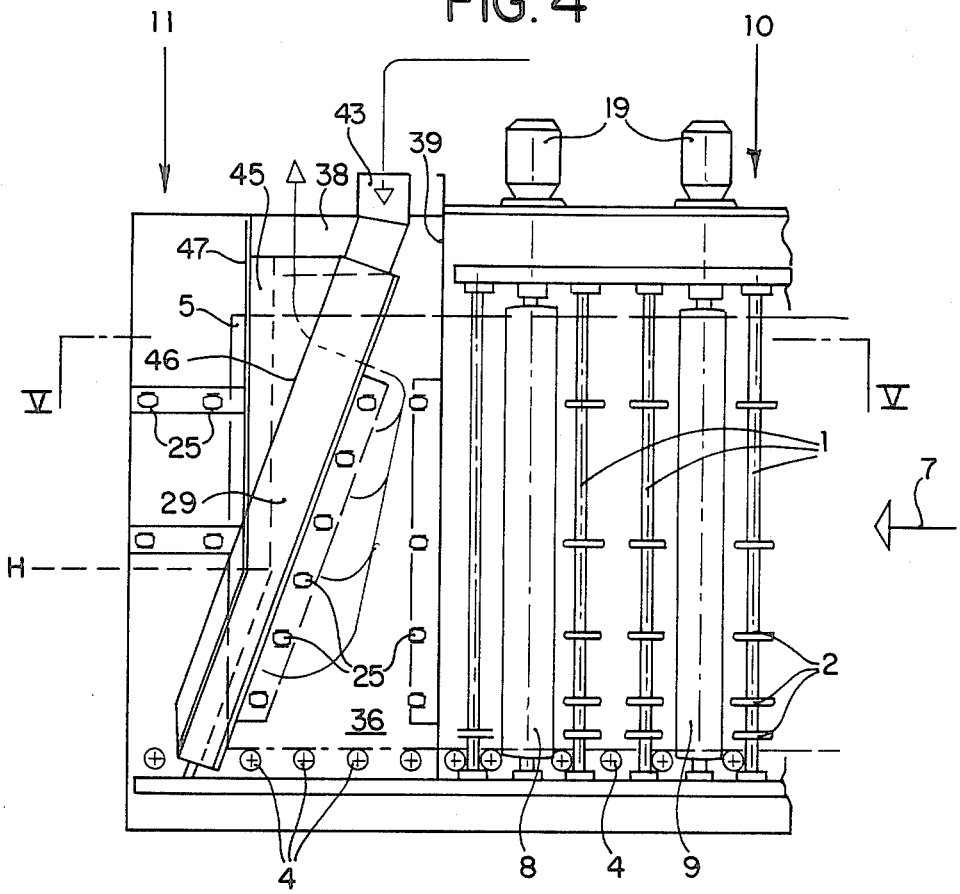
FIG. 4 is a view that is similar to FIG. 1 and shows a dryer which succeeds a washing machine and is designed in accordande with the second aspect of the invention.
Figure 5:
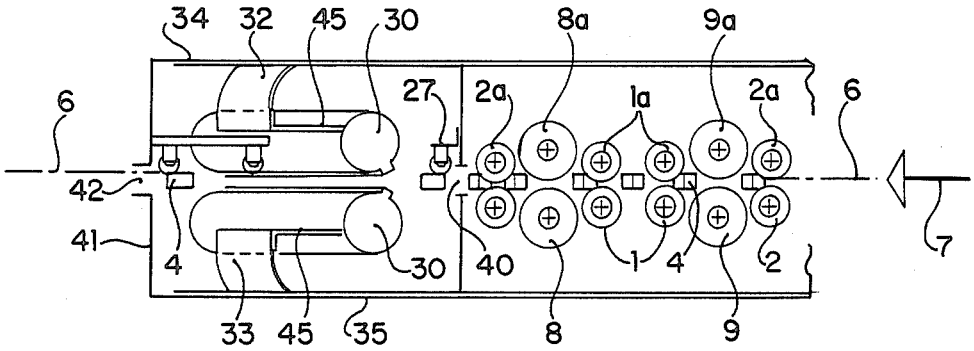
FIG. 5 is a transverse sectional view taken on line V—V in FIG. 4.

The second illustrative embodiment shown in FIGS. 4 and 5 agrees in numerous cases with the first illustrative embodiment. For this reason, identical or corresponding components are designed with the same reference characters. The following description is substantially restricted to those features by which the second illustrative embodiment differs from the first.

A first difference, which is not significant for the invention, resides in that the washing machine 10 and the dryer 11 are combined in a common housing.

The essential difference between the two illustrative embodiments resides in that the dryer of the second embodiment is shorter than the dryer of the first embodiment. This is due to the fact that the top ends of the blast nozzles 29 and 30 terminate at a much smaller distance from the entrance end wall 39 of the dryer than in the first illustrative embodiment. As a result, the space between the top ends of the blast nozzles and the entrance end wall 39 of the dryer is not sufficient to permit a sufficiently large exhaust air outlet to be provided in the adjacent portion of the top wall 31 of the housing. For this reason the exhaust air outlet 38 of the second illustrative embodiment extends in the direction of travel 7 beyond the top ends of the blast nozzles 29 and 30. This is possible without an elimination of the shielding between the humid first compartment 36 and the dry second compartment 37 of the dryer because the design of the shields has been altered. Up to a predetermined level H the shields 33 and 32 are designed and arranged as in the first illustrative embodiment. Above the predetermined level H each rubber lip extends vertically along the adjacent rear wall 34 or front wall 35 of the housing and the inner longitudinal edge of each shield is secured to a triangular partition 45, which is shown in elevation in FIG. 4. That longitudinal edge 46 of said partition 46 which faces the entrance end wall of the dryer is secured to the outside surface of the adjacent blast nozzle. The partition 45 extends in the direction of travel 7 and is preferably parallel to the plane of travel 6 for the glass plates. That edge 47 of the partition which faces the exit end wall of the dryer is joined to the rubber lip.

Owing to that arrangement an exhaust air duct having a uniform flow area is provided above the level H and the exhaust air can rise freely through said duct regardless of the height of the glass plate. Because the top ends of the blast nozzles 29 and 30 are adjacent to that exhaust air duct, the pipes 43 and 44 for supplying air to the blast nozzles extend through the exhaust air outlet 38 into the housing.

I claim:

1. A dryer for drying washed glass plates as they travel in a housing, which has a dryer entrance slot and a dryer exit slot and contains a horizontal conveyor for the glass plates, which conveyor comprises bottom members for supporting the bottom edge of said plate glass and backing elements for supporting the sides of said glass plate, said bottom members and said backing elements defining a plane of travel for the glass plates, said dryer also comprises elongate blast nozzles, which are respectively disposed on both sides of the plane of travel for the glass plates and are upwardly inclined opposite to the direction of travel and have air exit slots which face the plane of travel for the glass plates and extend from a level which is close to the level of the bottom members in a direction which is upwardly inclined opposite to the direction of travel, shields are provided and extending between respective blast nozzles and respective walls of the housing to define two chambers between said blast nozzles and said entrance slot , and an exhaust air outlet provided in said housing for exhausting humid air from said chambers , characterized in that the top end of each blast nozzle is spaced from the entrance end wall of the dryer and the exhaust air opening is formed in the top wall of the housing between the upper ends of the blast nozzles and the entrance end wall of the dryer.

2. A dryer according to claim 1, characterized in that the exhaust air outlet extends approximately from the entrance end wall of the dryer to a line which is vertically aligned with the top ends of the blast nozzles.

3. A dryer according to claim 1, characterized in that the exhaust air outlet extends substantially throughout the width of the top wall of the housing.

4. A dryer according to claim 1, characterized in that the exhaust air outlet extends approximately from the entrance end wall of the housing to a line which is vertically aligned with the top ends of the blast nozzles and substantially throughout the width of the top wall of the housing.

5. A dryer according to claim 1, characterized in that the exhaust air outlet extends in the direction of travel of the horizontal conveyor over a length of at least 20 cm, preferably over a length of 30 to 50 cm.

6. A dryer for drying washed glass plates as they travel in a housing, which has a dryer entrance slot and a dryer exit slot and contains a horizontal conveyor for the glass plates, which conveyor comprises bottom members for supporting the bottom edge of said plate glass and backing elements for supporting the sides of said glass plate, said bottom members and said backing elements defining a plane of travel for the glass plates, said dryer also comprises elongate blast nozzles, which are respectively disposed on both sides of the plane of travel for the glass plates and are upwardly inclined opposite to the direction of travel and have air exit slots which face the plane of travel for the glass plates and extend from a level which is close to the level of the bottom members in a direction which is upwardly inclined opposite to the direction of travel, shields are provided and extending between respective blast nozzles and respective walls of the housing to define two chambers between said blast nozzles and said entrance slot , and an exhaust air outlet provided in said housing for exhausting humid air from said chambers, characterized in that each shield extends between one of the blast nozzles and the adjacent side wall of the housing and is contiguous to said adjacent side wall up to a predetermined level along a line which is approximately parallel to the blast nozzle and above said level is contiguous to said side wall along a steeper line, and the exhaust air outlet is formed in the top wall of the housing at the top end of a duct which is defined by the shields and the entrance end wall of the dryer.

7. A dryer according to claim 6, characterized in that the shield is contiguous to the adjacent side wall of the housing along an approximately vertical line above said predetermined level.

8. A dryer according to claim 6, characterized in that air supply pipes opening into the top ends of the blast nozzle extend through the exhaust air outlet into the housing.

9. A dryer according to claim 8, characterized in that the exhaust air outlet extends in the direction of travel of the horizontal conveyor over a length of at least 20 cm, preferably over a length of 30 to 50 cm, plus the diameter of the air supply pipes.

10. A dryer according to claim 6, characterized in that the exhaust air outlet extends substantially throughout the width of the top wall of the housing.

* * * * *